US005857673A

United States Patent [19]

Ablonczy et al.

[11] Patent Number: 5,857,673

[45] Date of Patent: Jan. 12, 1999

[54] LOGICAL PLAYTHING FOR IMPROVING SPATIAL ORIENTATION AND JOINT FOR COUPLING FLEXIBLE PLATES

[76] Inventors: Daniel Ablonczy, Kossuth Lajos utca 94, H-2800 Tatabanya II; Jozsef Vadasz, Berda Jozsef utca 54, H-1045 Budapest, both of Hungary

[21] Appl. No.: 776,788

[22] PCT Filed: Jun. 1, 1995

[86] PCT No.: PCT/HU95/00021

§ 371 Date: Mar. 12, 1997

§ 102(e) Date: Mar. 12, 1997

[87] PCT Pub. No.: WO96/04971

PCT Pub. Date: Feb. 22, 1996

[30] Foreign Application Priority Data

Aug. 11, 1994 [HU] Hungary ..... P 9402338

[51] Int. Cl.[6] ..... A63F 9/08

[52] U.S. Cl. ..... 273/153 S

[58] Field of Search ..... 273/153 R, 153 S, 273/157 R, 156

[56] References Cited

U.S. PATENT DOCUMENTS

| | | | |
|---|---|---|---|
| 3,747,931 | 7/1973 | Tuan | 273/283 |
| 4,692,119 | 9/1987 | Ussery | 273/156 |
| 4,719,656 | 1/1988 | Godinet | 273/157 R |
| 5,310,183 | 5/1994 | Glikmann | 273/153 S |

FOREIGN PATENT DOCUMENTS

| | | | |
|---|---|---|---|
| 2527466 | 12/1983 | France | 273/153 S |
| 1416149 | 8/1988 | U.S.S.R. | 273/153 S |
| 2177929 | 2/1987 | United Kingdom | 273/153 S |
| 9219339 | 11/1992 | WIPO | 273/153 S |

*Primary Examiner*—Steven Wong
*Attorney, Agent, or Firm*—Young & Thompson

[57] ABSTRACT

The invention relates to spatial figures, figural arrangement or logical plaything for improving stereoscopic vision comprising bordering lattice plates (2) in a parallelepipedon form, wherein movable elements (1) being of nearly similar form to the enclosed space are accommodated. The number of the elements are one piece less than the elements having room in the available space. Movable elements (1) are distinguished by symbols, colours. Movable elements (1) are compressed while assembling and pressing flexibly to each other and the lattice plates (2). Movable elements (1) keep their spatial position against their weight. A coupling means is also disclosed for joining up angularly the flexible plates, which coupling consists of ribs (14) parallel with the plane of the plate (2) and perpendicular slots (12). These elements are arranged on the edges of the plates (2) and alternatingly can be snapped to each other.

8 Claims, 3 Drawing Sheets

LOGICAL PLAYTHING FOR IMPROVING SPATIAL ORIENTATION AND JOINT FOR COUPLING FLEXIBLE PLATES

FIELD OF THE INVENTION

The invention relates to a spatial logical plaything for developing stereoscopic vision and having a parallelepipedon-like shape, comprising movable elements of similar form filling up the available space inside, but leaving a volume non-occupied corresponding to the volume of a movable element. Said movable elements do not displace on the effect of their own weight.

The invention relates furthermore to a coupling structure for joining flexible plates angularly especially lattice side plates of said spatial logical plaything according to the invention.

PRIOR ART

There are known a lot of logical playthings comprising elements displaceable in a rectangular parallelepipedon formed space surrounded by frames or lattice plates, and the number of the elements is one piece less then the elements having room in the available space. By utilizing this single non occupied blank room it is possible to move the elements distinguished by symbols, colours for realizing a possible configuration, which is the end purpose of the play.

Such kind of plaything is described for example by the U.S. Pat. No. 3,845,959, furthermore the DE-PS 2,152,360 and finally the U.S. Pat. No. 4,036,503. The characterizing features of these prior art playthings are as follows:

The essence of the patent specification U.S. Pat. No. 3,845,959 is a closed, expediently cubical external case, wherein a central block with similar formation is located in the space bordered by six perpendicular side plates, and each surface of said central block is in equal distance from the relating side of the case. In the free area between the case and the central block movable blocks are found, the numbers of which are one piece less then the blocks having room in the available space, their shape is similar to the external case, their one or more surfaces can be distinguished from the central block. The openings on the sides of the case make possible to displace said movable blocks, and by selectively transferring them a particular interrelation or arrangement can be achieved, which means the realization of the task to be solved.

The characteristic of the plaything according to DE-PS 2,152,360 is in that in one frame—which expediently borders cubical space—similarly shaped geometrical bodies are arranged, the edge length of the frame is n-fold of the edge length (n=2, 3, . . . ) of the geometrical bodies, which can be moved in three directions parallel with the edge length of the frame, and in the frame $n^3-1$ pieces geometrical bodies are arranged. The object of the logical plaything is similarly the same as that of the previous plaything, i.e. the cubical geometrical bodies distinguished by symbols to each other should be arranged according to a pattern meeting the requirements of the task to be realized and predetermined in advance.

The patent specification U.S. Pat. No. 4,036,503 describes a manipulative logical plaything, comprising a case having perpendicular parallelepipedon formed transparent back- and front plates, the side plates of which are narrower than the front- and back plate, said casing comprises regular polyhedrons with similar form and arranged in a certain number columns next to each other. The number of the polyhedrons is one piece less than the number of polyhedrons which would have room in the available space of the case, whereby one column contains one polyhedron less than the other columns.

The width of the side plate and the height of the case are a little bit larger than the peak distance of the polyhedron, respectively the height of the highest column, whereby there is a possibility to rotate at least one polyhedron around its vertical center line by means of careful manipulation of the case as well as by means of horizontal torsion of the case, and it is also possible to turn to the lower column supporting on the lower edge of the polyhedron being on the top of the higher column.

These moving methods make possible to arrange the polyhedrons—expediently cubes—distinguisbed with symbols to provide a predetermined pattern.

The central block of the plaything according to the first U.S. patent specification on one hand, takes up the room from the further movable blocks, on the other hand it does not enable that the movable blocks should circulate in the whole space of the closed case, their motion can take place only along the six side plates on the surface.

In the case of the second described logical plaything, the movable geometrical bodies do not abut resiliently to each other and to a frame, therefore, except the case n=2, in the case of n=3, 4 the assembled plaything simply falls to pieces, as it has no side plate. Supposing that the plaything on its one plate is supported by palm in order to prevent the falling to pieces, it still does not operate, as only the position of the geometrical bodies being along the edge is determined, in lack of further side plates it does not comprise bounding-guiding surfaces, whereby their exact, one-unit transfer are not ensured and so they cannot provide as guiding surface for each other, moreover, they hinder the motion of the other one. If supposing the improbable state that each element is in its exact place, the one above the blank room will fall down independently of our will by its weight. The systematic arrangement of the cubes inside the plaything is totally impossible due to the above mentioned reasons.

The manipulation logical plaything according to the third mentioned U.S. patent specification is not a spatial plaything. Their elements are next to each other, arranged in one plane, their centre of gravity can move only two dimensions.

SUMMARY OF THE INVENTION

The aim of the invention is to eliminate the above mentioned disadvantages and realize a spatial element, particularly a logical plaything improving the stereoscopic or spatial vision and orientation, wherein the parallelepipedon shaped inner space of the plaything is bordered by plates and filled by a number of movable elements being of nearly similar form to the bordered space, the number of said movable elements being one piece less then the elements having room in the available inner space. Hereby the place of one movable element remains free. As no central core is available, owing to the special form of said movable elements they keep their spatial position against their weight and they can be moved parallel with their edges not only on the surface region of the plaything but in its whole inner space, whereby the variability, the curiosity, as well as the effect of improving stereoscopic vision are considerably increased considering the described known playthings without having a complicated construction.

Further object of the plaything according to the invention is to develop the aesthetical taste of human being, respectively to determine the logical steps making efforts to obtain aesthetic appearance.

The aim set is achieved by the invented logical plaything spatial structure enabling the improvement of spatial or stereoscopic orientation or vision. Said plaything has a parallelepipedon like shape and is bordered by lattice plates or grids. Inside movable elements are arranged which have a form nearly corresponding or similar form to that of the bordered space. The number of said elements being one piece less than the available inner space can accommodate, said elements are distinguished by symbols, colours. Said movable elements are resiliently pressing to each other and to the lattice plates, and this pressing effect keeps their spatial position against their weight. The distinguishing symbols os the movable elements in certain case may be arranged to show a pattern of a Vasarely style picture.

Preferably, the shape of the movable elements arranged in the space bordered by lattice plate is nearly cubical. Said elements are provided with flexible outward-swollen side plates. The movable elements may consist of a central element with side surfaces represented by flexible inserts.

The movable elements are preferably made of an elastic material with solid form without any hollow. The movable elements are preferably made of plastic, possibly of transparent plastic.

Furthermore, it is advantageous, if the lattice plate is made of a metal such as aluminium. The lattice plate can also be made of plastic, possibly transparent plastic.

Each movable element has a cubical shape and consists of six identical flexible square plates. On the edge of these flexible plates preferably joining surfaces inclining at the angle of 45° can be found, wherein alternatively slots and ribs are formed, and facing them to each other they can be snapped together, whereby the flexible side plates of the cubes are mutually determined by each other and form a quasi-rigid structure.

Expediently, by means of the plaything, besides the cube, further polyhedrons, geometrical demonstrating means, configurations showing the structure of the material, other scientific and educational means, objects and playthings with decorative effects can be realized.

So, it is advantageous, if the space bordered by lattice is of cubeform, so the movable elements are also cubes, which contact each other by flexible, thin, side plates with convex surface of great radius, and along one edge of the bordered space there are "n" pieces plates, while in the whole space $n^3$ pieces are available (n=2, 3, 4, . . . ).

The movable elements are favourably assembled from thin, flexible cubical plates or central elements and flexible inserts.

In the case of an other favourable embodiment, the movable element is made of a solid but flexible material.

The components of the movable elements are made of plastic, possible transparent plastic, while the lattice plates are made of metal or plastic, possible also transparent plastic material. In the case of utilizing transparent materials, the structure of the space under the surface can be also seen, which together with the moving possibilities make the possibility for producing really spatial tasks to be solved.

An other essential aspect of the invention is in that the plaything according to the invention enables the multiple utilizations, if its plates simply but releasably join to each other. For this task such a coupling means should be provided which is rigid enough to keep the moving elements without falling to pieces under the straining effect of the resiliently compressed moving elements while using, however, it can be simply disassembled and there is no need for any tools.

The aimed task has been solved by a coupling arrangement according to the invention which is suitable for angularly joining flexible plates especially the lattice side plates of said spatial logical plaything. The coupling means consist of joining elements arranged on the edge of the plates, and the edges of the plates form bearing surfaces being in the median plane of the joining angle of the plates. On the bearing surfaces ribs and slots are arranged alternatingly. The ribs have a first surface parallel with the plane of the plates and joining to said bearing surface, and have an inclined endface joining to said first surface. Said slots have a second surface joining to said bearing surface and perpendicular to the plane of said plate, in coupled position of the plates, said second surface of a slot of a plate is in contact with said first surface of a corresponding rib of the coupled plate. In joint position between the ribs and the slots joint to them there is an overlap. Due to this overlap, the ribs and the slots snapped into each other fix the plates, but thanks to their flexibility it can be also released.

BRIEF DESCRIPTION OF THE DRAWINGS

The invention is described in detail referring to the enclosed drawings demonstrating the embodiment of the solution according to the invention by way of example, in which:

FIG. 7 is a sectional view of the movable element, while

DESCRIPTION OF THE PREFERRED EMBODIMENTS

Figure 1:
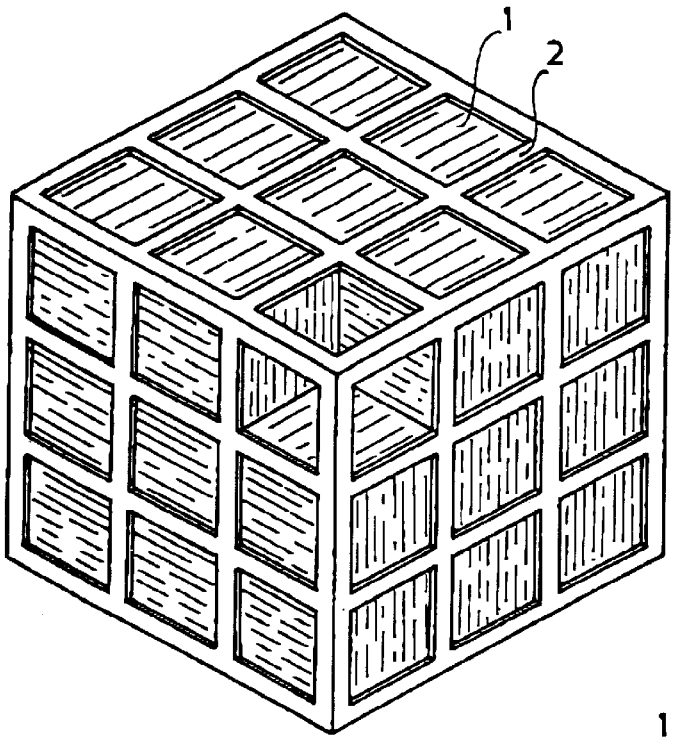
FIG. 1 is an axonometrical view of the plaything.
Figure 2:
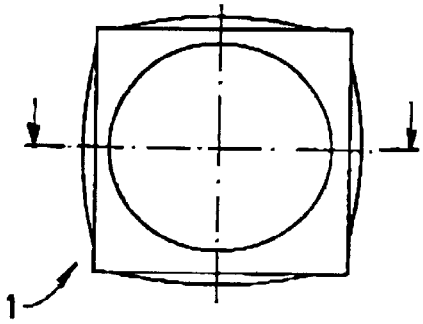
FIGS. 2 and 3 illustrate a possible and practical construction of the cubical movable element.
Figure 3:
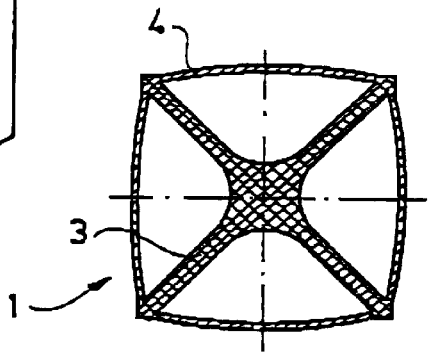
Figure 4:
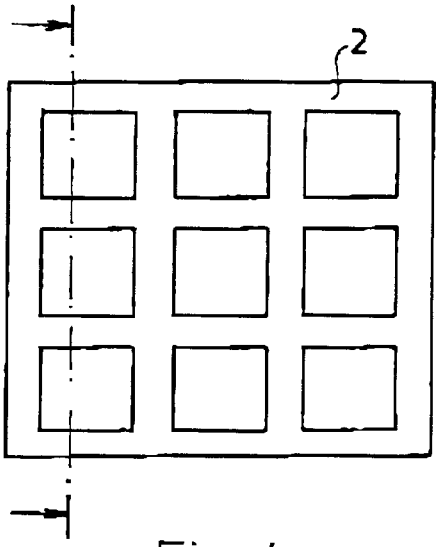
FIGS. 4 and 5 show an outer and a sectional view of the plaything as well as of another preferred type of the movable elements.
Figure 5:
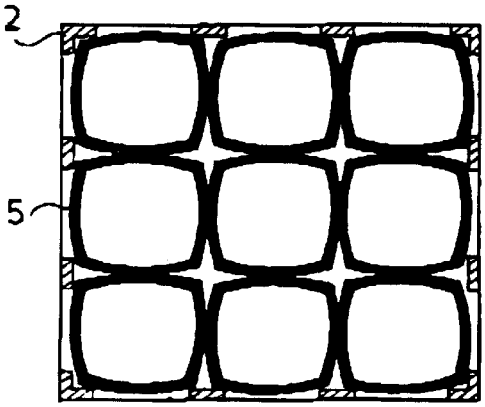

FIGS. 1, 4 and 5 contain lattice plates 2 having a plurality of holes and embracing a cubical area. This closed space accomodates cubical movable elements 1 thereby plates 2 serving as a cage on border and a guiding inner surface. The openings thereon enable moving and observing movable elements 1. Said movable elements 1 are formed either by the flexible square plates 5 or by a central element 3 and flexible inserts 4 and are arranged inside the space bordered by the flexible lattice plate 2.

The movable elements 1 are essentially cubical, but a little convex. While assembling they become a little flattened and compressed, consequently they tend to slightly flexibly expand against each other and the lattice plates 2, whereby under the effect of frictional force developing between them they keep their position against their own weight and do not fall or slip forward blank place.

Figure 6:
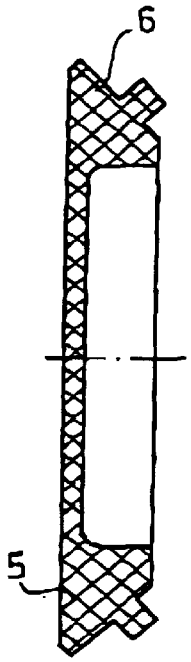
FIG. 6 illustrates a movable elements assembled by snapping into each other flexible quadratic plates.
Figure 7:
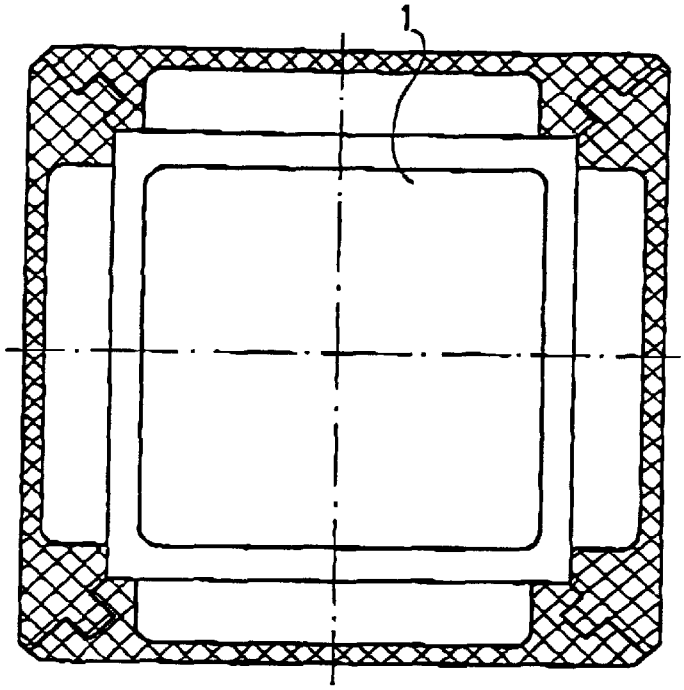
Figure 8:
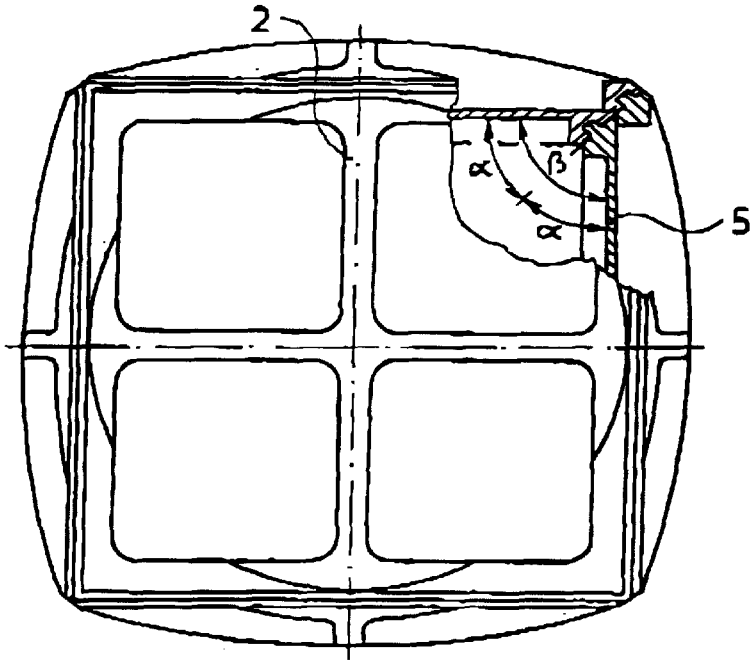
FIG. 8 shows the angles $\alpha$ and $\beta$ of the lattice plate and of the flexible quadratic plate as well as their assembled state.

The section of the movable elements 1 snapped from six flexible square plates having exactly the same formation according to the FIG. 6 can be seen on the FIG. 7. On the contacting surface of the flexible cubical plates 5 inclined at the angle of "α" (in case of a cube α=45°) slots and ribs are alternatingly arranged, which, form complementary pairs and can be snapped into each other involving flexible deformation causing no breaking or cracking. The flexible square plates 5 are determining mutually each other and form a quasi-rigid cubical structure without any clearance. As it can be seen on FIG. 6 on the connecting contact surfaces of the flexible plates 5 a hollow 6 can be arranged, which facing to each other form slot facilitating thereby the release or disassembly. The lattice plates 2 can be formed and assembled using the same principle. The advantages of the mentioned constructional solution are as follows:

- one type of components can be utilized for assembling said movable element 1;
- the flexible square plate 5 is thin with inconsiderable material needs;
- the six flexible square plates 5 forming the movable element 1 can be of six different colours, there is no need for post-colouring, printing in order to distinguish the movable elements 1;
- quick assembling by means of snapping in without the use of any adhesive, simple disassembling.

The above mentioned advantages ensure together economical, practical manufacture as well as the reliable quality.

The plates 5 of the movable elements 1 can be provided with a design or colour, that e.g. realizing a particular arrangement a characteristic appearance e.g. that of a Vasarely style picture can be formed. This renders considerable help for realizing a prescribed or wanted configuration besides the aesthetic quality.

The use of the plaything according to the invention is described as follows:

Taking into hand a plaything being in a random arrangement and knowing the spatial pattern to be realized by rearranging the movable elements 1 one of the movable elements 1 can be slided in the direction of the blank room by overcoming the developed frictional force by fingers through the openings of the lattice plates 2.

The movable elements 1 can be moved from three directions of the space towards the blank room available on the tips, sides or edges. The mentioned moving can be complete or partial considering the lines and columns of elements 1. If the blank room can be found on an edge or corner, in this case moving can take place only on the surface in three directions. If the blank room can be found on any of the sides of the plaything, in this case moving in two directions can take place on the surface (in two directions) while the third direction moving can be realized inside the plaything.

A blank or free room can be realized for example on the edges or on the plates between the contacting surfaces of the two determined movable elements 1 at some opening of the lattice plates 2, that the mentioned contacting surfaces are moved into the middle of the openings whereby a blank room is formed. To obtain a blank room at a corner, the movable element 1 being there will be moved toward the blank room on the free surface perpendicular to the direction of the moving. At changing the place movable elements 1 should be caused to move up to impact, in this case the lattice plates 2 and movable elements 1 provide guide to each other. By using the above mentioned moving methods any spatial relation, pattern can be realized between the distinguished movable elements 1, so does the aimed task can be solved.

The constructional formation of FIG. 7 enables creating besides the cube, various spatial figures joint by polyhedrons by means of connecting adequately shaped flexible plates in order to form spatial geometrical demonstration means, figures showing the structure of the material, other, scientific and educational means, objects and playthings with decorative effects. Depending on the various polyhedron types, the angle "α" means the half of the angle included by two walls of the polyhedron. For example, in the case of a dodecahedron (consists of 12 pcs pentagons) β=116°,56°, α=58°,28°.

FIG. 6 shows the form of said hollow 6 enabling disassembling the logical plaything according to the invention or the various spatial figures joint by polyhedrons in order to change initial pattern by means of a new assembling order between the symbols and colours of the proper formed flexible plates 5 bordering the polyhedrons. By this means, new tasks can be created, other spatial figures can be formed by joining polyhedrons, new colour effect and formation can be achieved.

Figure 9:
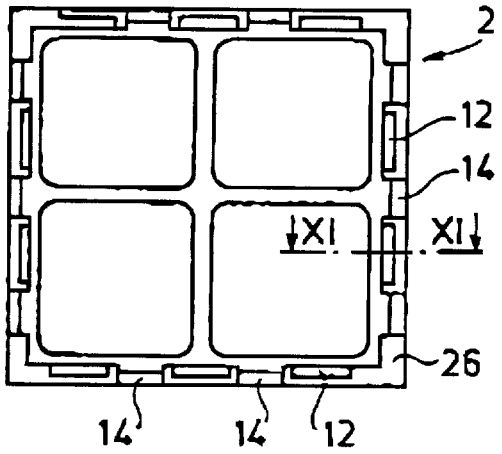
FIG. 9 illustrates the inner side of the lattice plate of the plaything with the coupling means according to the invention.
Figure 10:
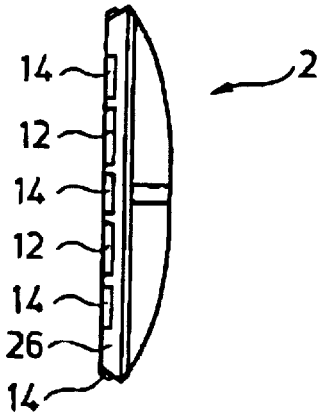
FIG. 10 is the lattice plate according to the FIG. 9 showing from the direction of the edge.
Figure 11:
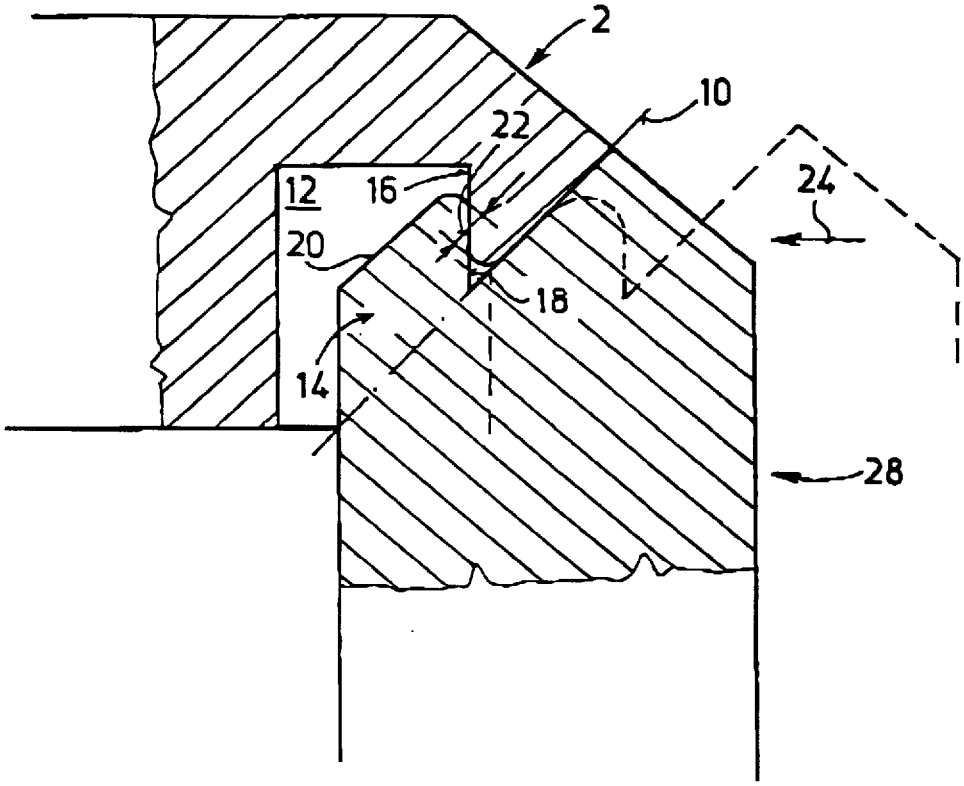
FIG. 11 is the enlarged sectional view of the lattice plate according to the FIG. 9 along the line XI—XI with the relating details of the other lattice place joined thereto.

FIGS. 9 to 11 show the preferred embodiment of the plate 2, and this at the same time represents the coupling means according to another aspect of the invention. The edges of the lattice plate 2 and another plate 28 of the same geometry abut to each other along a bearing surface 26 laying in the median plane 10 of the planes characteristic to plate 2 and plate 28. The coupling means contains slots 12 and ribs 14 arranged alternatingly along the plates 2 joining angularly to each other, in the present case they join perpendicularly to each other. The slots 12 sink perpendicularly to the plain of the plate 2 and extend at least partly on the bearing surface of the plate 2. The slot 12 has a second surface 16 extending to the bearing surface 26, which is perpendicular to the plane of the plate 2 and parallel with the plane of the adjoining plate 28. The ribs 14 protrude from the bearing surface 26 parallel with the direction of the plane of the plates 2, 28, their height can be accommodated in slots 12. The length of the ribs 14 is less than the relating slots 12. The ribs 14 have surfaces 18 in joint position contacting with the surface 16 of the slots 12, and to the surface 18 inclined endfaces 20 are connected. The edge at the joint of surfaces 18 and endfaces 20 can be rounded. The edge of the surface 16 of the slots 12 at the bearing surface 26 can be also rounded. The external edge of the plates 2 and 28 is bevelled at their juncture, but not necessarily.

In released position approaching plate 28 (see FIG. 11, outline with dashed line) in direction of arrow 24 to the plate 2 the ribs 14 impact to the bearing surface 26. The same will take place, if plates 2 and 28 are approached to each other in a direction perpedicular to median plane 10. However, thanks to the slope of the endface 20 and to the rounded form of the contacting edges of surfaces 16 and 18 at snapping the side plates 2 and 28 will be deflected laterally, perpendicularly to their plane and take an undulated form corresponding to the alternating arrangement of the ribs 14 and the slots 12, meanwhile the ribs 14 snap into the slots 12. The greater is the rate of the depth and the length of the slots 12 with respect to ribs 14, the easier is realized this snapping. After snapping the edges of the plates 2 and 28 will straighten and flexible fit comes into being between them. The strength of the connection is influenced by the length of the ribs 14 and the slots 12, the extent of the rounding-off, the rigidity of the plates 2 and 28, (more exactly their flexibility), and the size of the overlapping—as it can be seen on FIG. 11—which can be measured in the plane parallel with the median plane 10.

It is appreciated that the coupling means shown on FIGS. 9 to 11, can be applied for joining angularly, especially perpendicularly the edges of any of the flat plate type bodies, if at least the edges of the plate can be flexibly corrugated perpendicular to the plane of the plate. By the aid of this structure for example, boxes, walls, and folding-screen can be formed.

This coupling means makes possible to separate from each other side plates 2 of the plaything according to the invention, to change or replace the movable elements 1, or their pattern or order or orientation can be rearranged. Hereby any start position can be simply formed, the object and the process of the play can be changed.

We claim:

1. A logical plaything for improving stereoscopic vision comprising;

plastic lattice plates releasably joined to each other to define a confined space;

movable elements located displaceably inside said space, the number of said movable elements being one piece less than the elements having room in said space, and at least some of said movable elements having distinguishing symbols and/or colors characterized in that said movable elements are provided with elastically compressible convex side surfaces and have outer dimensions adapted to fit in compressed state into the space confined by said lattice plates;

said lattice plates comprising joining elements arranged on the edge of the plates formed by bearing surfaces being in a median plane of the joining angle of two adjacent plates;

said joining elements comprising ribs and slots arranged alternating on said bearing surfaces;

said ribs comprising a first surface parallel with the plane of said plates and joining to the bearing surface, and an inclined endface joining to said first surface;

said slot comprising a second surface joining to the bearing surface and perpendicular to the plane of the plate, wherein in joined position of two adjacent plates, said second surface is in contact with said first surface and said ribs and said slots overlap.

2. The plaything of claim 1, wherein the joining edge of said first surface and said bearing surface, and of said second surface and said endface are rounded.

3. A plaything comprising lattice plates releasably joined defining a confined space;

elastically compressible movable elements located within said space;

said lattice plates comprising cooperating joining elements arranged on the edge of the plates formed by bearing surfaces being in a median plane of the joining angle of two adjacent plates; and said joining elements comprising ribs and slots arranged alternating on said bearing surfaces, wherein in a joined configuration said ribs of a first lattice plate and slots of a second lattice plate join by interlocking.

4. The plaything of claim 3, wherein said ribs comprising a first surface parallel with the plane of said plates and joining to the bearing surface, and an inclined endface joining to said first surface;

said slot comprising a second surface joining to the bearing surface and perpendicular to the plane of the plate, wherein in joined position of two adjacent plates, said second surface is in contact with said first surface and said ribs and said slots overlap.

5. The plaything of claim 3, wherein said lattice plates remain sufficiently rigid to keep said movable elements contained within said space during movement of said movable elements, yet yields to a force applied at said lattice plate edge to disjoin said ribs of said first lattice plate from said slots of said second lattice plate.

6. A logical plaything for improving stereoscopic vision comprising plastic lattice plates releasably joined together to confine a space, said space containing movable elements located displaceably inside said space, the number of said movable elements being one piece less than the elements having room in said space, and at least some of said movable elements having distinguishing symbols and/or colors, said lattice plates comprising joining elements arranged on the edge of the plates formed by bearing surfaces being in a median plane of the joining angle of two adjacent plates, said joining elements are ribs and slots arranged alternating on said bearing surfaces and said ribs have a first surface parallel with the plane of the plates and joining to the bearing surface, and have an inclined endface joining to said first surface, said slot comprising a second surface joining to the bearing surface and perpendicular to the plane of the plate, in joined position of two adjacent plates said second surface is in contact with said first surface, in joint position between said ribs and said slots joint to them there is an overlap, wherein said movable elements are provided with elastically compressible convex side surfaces and said movable elements have outer dimensions adapted to fit in compressed state into the space confined by said lattice plates.

7. The logical plaything of claim 6, wherein joining edges of said first surface and said bearing surface and joining edges of said second surface and said endface are rounded.

8. A logical plaything for improving stereoscopic vision comprising lattice plates releasably joined together to confine a space, said space containing movable elements located displaceably inside said space, the number of said movable elements being one piece less than the elements having room in said space, and at least some of said movable elements having distinguishing symbols and/or colors, wherein said movable elements are provided with elastically compressible convex side surfaces and said movable elements have outer dimensions adapted to fit in compressed state into the space confined by said lattice plates and said movable elements consists of six pieces of identical flexible square plates, said flexible square plates comprising edge surfaces inclining at an angle of 45°, slots and ribs on said edge surfaces, wherein ribs of a first plate releasably engage facing slots of an adjoining second plate to perpendicularly join said first plate with said second plate.

* * * * *